United States Patent [19]

Moore

[11] Patent Number: 4,998,419

[45] Date of Patent: Mar. 12, 1991

[54] PROCESS FOR KNITTING LOOP PILE

[76] Inventor: Rosemary V. A. Moore, 28A Manchester Street, London W1M 5PF, England

[21] Appl. No.: 303,041

[22] Filed: Jan. 26, 1989

Related U.S. Application Data

[63] Continuation of Ser. No. 144,916 filed as PCT GB87/00315 on May 11, 1987, published as WO87/06960 on Nov. 19, 1989, abandoned.

[30] Foreign Application Priority Data

May 9, 1986 [GB] United Kingdom ..... 8611412

[51] Int. Cl.[5] ..... D04B 9/06; D04B 1/02

[52] U.S. Cl. ..... 66/25; 66/194; 66/200; 66/202

[58] Field of Search ..... 66/177, 202, 25, 136, 66/194, 200, 172 E, 180

[56] References Cited

U.S. PATENT DOCUMENTS

| | | | |
|---|---|---|---|
| 2,946,211 | 7/1960 | Morancy | 66/200 |
| 3,035,427 | 5/1962 | Chiodine | 66/200 |
| 3,985,004 | 10/1976 | Johnson et al. | 66/177 |
| 4,772,202 | 2/1988 | Imboden | 66/177 |

FOREIGN PATENT DOCUMENTS

| | | | |
|---|---|---|---|
| 795900 | 1/1936 | France | 66/202 |
| 843773 | 4/1939 | France | 66/202 |
| 82525 | 6/1971 | German Democratic Rep. | 66/200 |
| 916991 | 1/1963 | United Kingdom | 66/202 |
| 1207852 | 10/1970 | United Kingdom | 66/202 |
| 1535397 | 12/1978 | United Kingdom | 66/172 E |
| 2151269 | 7/1985 | United Kingdom . | |

*Primary Examiner*—Wm. Carter Reynolds
*Attorney, Agent, or Firm*—Edward H. Renner

[57] ABSTRACT

A contractible (elastic) and a non-contractible (non-elastic) yarn are knitted together with the contractible yarn floating over at least some needles in a course of knitting. The non-contractible yarn also floats over at least some of the needles where the contractible yarn floats, with the result that a loop pile fabric is produced.

13 Claims, 1 Drawing Sheet

PROCESS FOR KNITTING LOOP PILE

This is a continuation of co-pending application Ser. No. 07/144,916 filed as PCT GB87/00315 on May 11, 1987, published as WO87/06960 on Nov. 17, 1987, now abandoned.

The present invention relates to a process for producing a knitted fabric and to the novel fabric thereby produced. It provides novel uses for a contractible (e.g. elastic) yarn to achieve an irregular surface effect.

The invention is designed to produce a fabric having on at least one face a loop pile structure, which may resemble towelling. The invention employs a knitting machine and it an essential requirement that the knitting machine should have at least two (and preferably only two) sets of needles; preferably, the knitting machine employed is of the cylinder and dial (or "double Jersey") type, but other knitting machines in which the needles are arranged in straight or essentially straight lines (as opposed to the circular array of the cylinder and dial machines) may also be employed.

The unique structure of the fabric of the invention is made possible by the employment of two different types of yarn, one being contractible and the other being non-contractible. The contractible yarn may be elastic or, if non-elastic, is shrinkable upon the application of appropriate treatment, e.g. heat treatment. The non-contractible yarn is non-elastic and, where the contractible yarn is shrinkable, the non-contractible yarn should not be shrinkable under the same conditions. In the present invention, I prefer that the contractible and non-contractible yarns should be elastic and non-elastic, respectively.

In accordance with the present invention there is provided a process for knitting a loop pile fabric on a knitting machine having a first set of needles and a second set of needles, wherein a non-contractible yarn is knitted on said first and second sets of needles and a contractible yarn is knitted on said second set of needles only, such that, in each course, said yarns are knitted for at least one stitch and float together over a plurality of needles, a pattern of knitting and floating repeating along said course of the fabric, so that, when said contractible yarn is contracted, said non-contractible yarn forms raised loops upon one face of the fabric.

It is a highly preferred embodiment of the invention that the contractible yarn should be fed to said second set of needles by means (e.g. a lay-in attachment) which feeds the yarn to the needles from a position remote from the position of feed of the non-contractible yarn, to avoid entanglement of the contractible yarn with the first set of needles knitting the non-contractible yarn.

Depending on the desired weight of the fabric, it is possible to feed via each feeder of the knitting machine one or more ends of said non-contractible yarn, preferably from 1 to 5, more preferably from 1 to 3, ends. Similarly, it is possible to feed one or more, e.g. from 1 to 5, more preferably from 1 to 3, ends of the contractible yarn.

The terms "non-contractible" and "contractible", as applied herein to a yarn, refer to the state of that yarn only in the course of the knitting process.

As noted, the contractible yarn can either be elastic or it can be shrinkable. Where it is elastic, it must be held under tension during knitting in order that, after knitting, its natural elasticity will cause it to contract. Where the contractible yarn is a shrinkable yarn, it should be subjected to the necessary treatment to cause it to shrink, for example subjected to high temperatures, e.g. by immersion in very hot water, or by chemical treatment. Since the contractible yarn is not knitted into the fabric over those sections where it floats, on these sections, it contracts and bunches the fabric together; where it is knitted in, it is prevented from contracting by the non-contractible yarn.

Where the contractible yarn is an elastic yarn, the resulting fabric will have substantial elasticity, comparable with that of the yarn itself. This contrasts with the conventional type of fabric where elastic and non-elastic yarns are knitted together, where the elasticity of the fabric is severely constrained by the presence of non-elastic yarns.

It is highly desirable that the floating sections of contractible yarn should be on the reverse of the fabric. If the number of stitches per course in which the contractible yarn is knitted in is kept to a minimum, then the face of the fabric will consist mostly of the non-contractible yarn and the appearance of the contractible yarn will be minimised.

In a preferred embodiment of the invention, a course of the fabric comprises a plurality of groups of stitches, in which: each group comprises a plurality of stitches in which said contractible and non-contractible yarns are knitted in by said second set of needles, each adjacent pair of stitches within said group being separated by a region where said contractible yarn floats over at least a single needle whilst said non-contractible yarn is knitted in by said first set of needles; and adjacent pairs of said groups being separated by a region where said contractible and non-contractible yarns float over a plurality of needles.

Preferably, in each course the number of needles corresponding to said groups is less than the number of needles corresponding to said regions between groups.

In order that the fabric should have an adequate loop pile on the one face, it is desirable that the number of needles in each course where no knitting takes place should substantially outnumber the number of needles where knitting does take place. In a preferred embodiment, the ratio of the number of needles where no knitting takes place to the number of needles where knitting takes place is at least 2:1, more preferably at least 3:1 and most preferably at least 4:1. In a particularly preferred embodiment, in each course there is a repeating pattern comprising the following in sequence:

(a) knit from 1 to 3 stitches of said contractible and non-contractible yarns on said second set of needles;

(b) miss from 1 to 3 stitches on said second set of needles and knit said non-contractible yarn on said first set of needles;

(c) repeat (a) and (b) the desired number of times, generally a further 1 to 3 times;

(d) optionally, repeat (a);

(e) miss on both sets of needles from 4 to 15, preferably from 6 to 12, stitches (counting stitches missed on said first set of needles); and (f) repeat (a)–(e) along the course.

More preferably, this comprises:

(a) knit one stitch of said contractible and non-contractible yarns on said second set of needles;

(b) miss one stitch on said second set of needles and knit 1 corresponding stitch of said non-contractible yarn on said first set of needles;

(c) repeat (a) and (b) a further 1 or 2 times;

(d) optionally, repeat (a);

(e) miss from 6 to 12 stitches on both sets of needles; and (f) repeat along the course of the fabric.

In Step (f) the repeats may be precisely the same as the pattern of those stitches and misses in the preceding steps or the pattern may vary slightly, but within the proportions prescribed in Steps (a)–(e).

The pattern of knitting and missing on the second set of needles will be essentially the same as that described above for the first set of needles, but may differ by one or two stitches, as necessary, to achieve the desired pattern.

It is possible for the pattern in each adjacent pair of courses to be in register, so as to form vertical rows of stitches; alternatively, the pattern in each adjacent pair of rows can be offset by, for example, one or two stitches, so that the rows of stitches form a diagonal pattern.

Knitting machines conventionally are supplied with closely packed arrays of needles. In order to achieve the desired pattern, it is possible for unused needles to be physically removed from the machine, so as to avoid their interfering with the knitting of the fabric.

Where a cylinder-and-dial (double Jersey) machine is employed, I prefer that the said first set of needles should be the cylinder needles and the said second set of needles should be the dial needles.

The invention has been described above in relation to the use of only two different yarns: a contractible yarn and a non-contractible yarn. Of course, it is possible, and in many cases desirable, to use more than two different kinds of yarn, e.g. two or more contractible yarns and/or two or more non-contractible yarns. Modern knitting machines are well-equipped to handle a multiplicity of different yarns. For example, in one embodiment of the invention, knitting is carried out as described above with the aforementioned contractible yarn and the non-contractible yarn (referred to, in this context, as the "first non-contractible yarn") and then a second non-contractible yarn is introduced via a further feeder so as to knit on some or all of the needles of the second set (i.e. in the preferred embodiment using a machine of the cylinder-and-dial type, on some or all of the dial needles). If the pattern of knitting of this second non-contractible yarn follows the same or essentially the same pattern of knit-and-miss as the first non-contractible yarn or as the contractible yarn, the resulting fabric will be a double-sided fabric having a loop pile on both faces with the contractible yarn (in its contracted state) in the middle. Alternatively, if the second non-contractible yarn is knitted on all or substantially all of the needles of said second set, then the face of the fabric formed by the second non-contractible yarn will (when the contractible yarn is contracted) have a solid appearance with an irregular puckered effect, whilst the face of the fabric formed by the first non-contractible yarn will comprise the loop pile described above. Again, the contractible yarn (in its contracted state) will be sandwiched between the two faces.

A wide range of yarns can be employed in the invention. Indeed, virtually any yarn, be it synthetic or natural, may be employed as the non-contractible yarn or yarns. The precise non-contractible yarn selected will be chosen primarily with regard to the desired appearance and feel of the fabric and (although the appearance and feel may be highly important in relation to the perceived value and usefulness of the fabric) is not critical to the process of the present invention. If an elastic yarn is fed to the knitting machine under zero tension, then it will function as a non-contractible yarn and may be used as such. This will produce a fabric of considerable elasticity. However, the non-contractible yarn is preferably a non-elastic yarn. Suitable non-elastic yarns include tricel, cotton, polyester, linen, viscose, viscose rayon, viscose acetate, dicel duracol, tricel duracol, polyamides (including nylon), wool, cashmere, alpaca, mohair, viscose/cotton, saran, glass fibres, triacetate, camel, merino or silk.

On the other hand, the choice of contractible yarn is of more significance to the structure of the fabric produced by the present invention. If the contractible yarn is a shrinkable yarn having a large shrinkage or a highly elastic yarn fed under sufficient tension to manifest fully its elasticity, then the raised loops formed on one face of the fabric by the non-contractible yarn will be bunched very tightly together to form a very close pile, with a corresponding reduction in the area of fabric produced from a given length of yarn. On the other hand, if the contractible yarn is a shrinkable yarn having a relatively low shrinkage or is an elastic yarn having a relatively low elasticity or fed under relatively low tension, then the loops of the non-contractible yarn on said face of the fabric will be bunched together much more loosely. Examples of suitable elastic yarns include shirring elastic and various spandex fabres, particularly that sold under the trade name "Lycra". A particularly suitable yarn is a high shrink acrylic yarn. If desired, the elastic yarn may be a covered elastic yarn, in which an elastic yarn (such as those exemplified above) is covered with a wound coat of another (normally non-elastic) yarn, such as a nylon yarn.

Where the contractible yarn is a shrinkable yarn, the amounts of shrinkable yarn and non-contractible yarn (or first non-contractible yarn) are preferably approximately equal, based on the length of the two yarns prior to shrinkage. Where the contractible yarn is an elastic yarn, the length of the elastic yarn under tension is preferably about the same as the length of the non-contractible yarn (or of the first non-contractible yarn), but its length in the relaxed state is necessarily less. A preferred ratio of the relaxed length of elastic yarn to length of non-contractible yarn (or first non-contractible yarn) is from 1:5 to 29:30, more preferably from 1:3 to 6:7 and most preferably about 1:4.

By appropriate control of the needle set-out or the needle selection, it is possible to produce a fabric in which a part (which may be a major or minor part) is in accordance with the invention and another part or parts is of a conventional knit pattern. By this means various novel fabric designs can be produced. It is not necessary that the entire fabric be produced in accordance with the present invention.

The invention is further illustrated by the accompanying drawings, in which.

Figure 1:
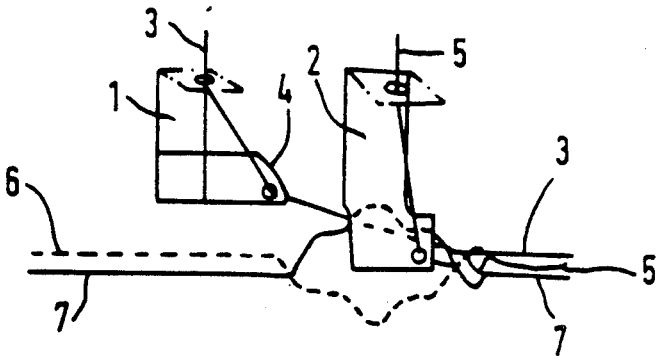
FIG. 1 shows the arrangement of dial and cylinder needles and the feeder arrangement for one embodiment of the present invention.

Referring to FIG. 1 of the drawings, the knitting machine includes two feeders 1 and 2. Feeder 1 is blank, but an elastic yarn, e.g. Lycra, 3 is fed by means of a lay-in attachment 4 behind the cylinder needles, so that it knits only on the dial needles at feeder 2. Meanwhile, feeder 2 supplies a non-contractible yarn 5, which forms the face or effect yarn, to knit on all available needles. The path of the dial needles is shown at 6 and the path of the cylinder needles is shown at 7.

Figure 2:
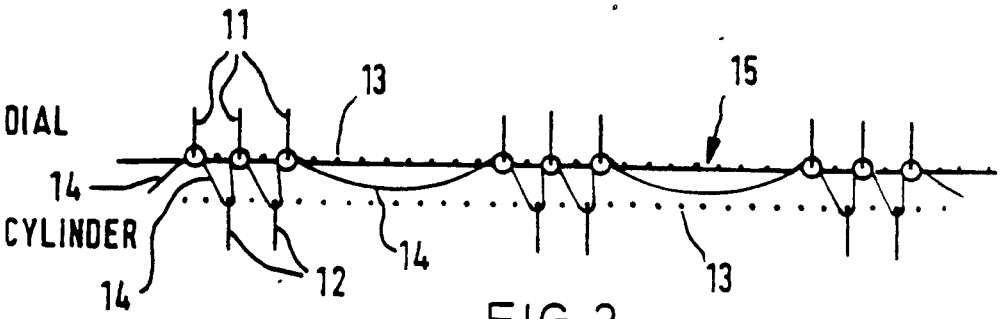
FIG. 2 shows an example of a needle layout and yarn path in accordance with the present invention.

In FIG. 2, the vertical lines 11 show the positions of needles which have been retained in the dial, whilst the vertical lines 12 show the position of needles which have been retained in the cylinder. The dots, e.g. those marked 13, show positions where needles have been removed. The path of the non-contractible yarn is shown at 14, whilst the path of the contractible yarn is shown at 15. As can be seen, the non-contractible yarn 14 is first knitted by one of the dial needles 11, and is then knitted by a cylinder needle 12, followed by a dial needle, a cylinder needle and another dial needle. The yarn then floats over a path equivalent to 8 dial needles (or 10 cylinder needles), before the pattern is repeated. The contractible yarn 15 is knitted by the three dial needles 11 and then floats over a path equivalent to 8 dial needles, before the pattern repeats.

Figure 3:
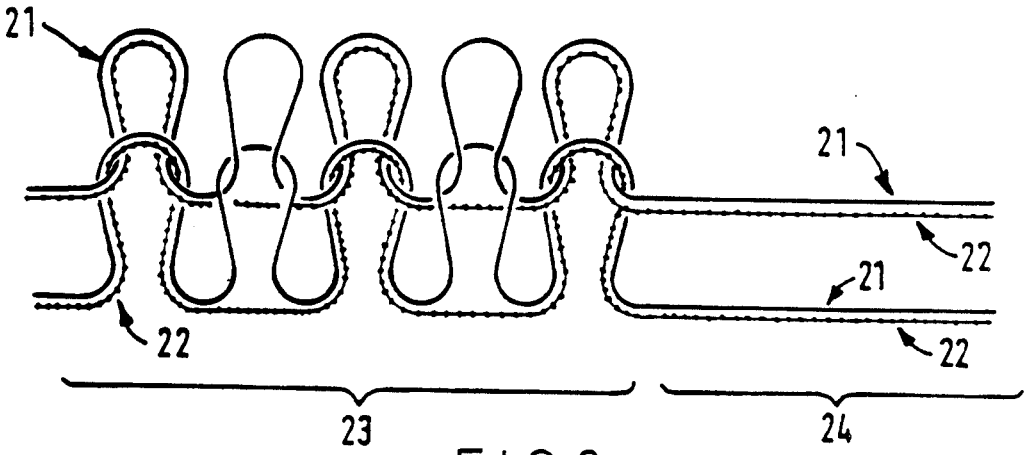
FIG. 3 shows an example of a part of a pair of courses of knitting employing the needle set out shown in FIG. 2.

FIG. 3 shows a part of a pair of adjacent courses of knitting employing the needle set-out shown in FIG. 2. 2 ends of a non-elastic yarn 21 are knitted in with a single end of an elastic yarn 22. In each course, there is a region 23 where both yarns are knitted in, followed by a region 24 where both yarns float.

It will, of course, be appreciated that the needle set-outs of both dial and cylinder can be altered, if desired, to give variations of the loop pile effect.

On fully relaxing the elastic yarn, the fabric, which has been under tension, returns to its relaxed unstretched state, thus pulling together the dial needle loops until adjacent loops touch. In a conventional double Jersey knitting machine, the fabric shrinks from approximately 24 inches (about 60 centimeters) to between 8 and 12 inches (about 20 to 30 centimeters), depending upon elasticity and the proportion of knits to misses in each course of the yarn. On inspection, the reverse of the fabric in its relaxed state may be seen to be made up of vertical arrangements of knitted loops, separated by horizontal straight lines, both made up of the elastic yarn. The face of the fabric is made up of vertical knitted loops and large floats, which raise up and twist to give the loop pile effect.

The high elasticity of fabrics achievable by the process of the invention leads to some exciting possibilities. For example, garments, e.g. ladies' swimsuits, can be prepared by knitting a tube of fabric on a knitting machine and then forming the garment by a few simple cutting and sewing operations. In the case of a ladies' swimsuit, this may be done by cutting scallops for shoulder and leg holes and then sewing together the appropriate parts of the fabric to form straps and a crotch portion. The elasticity of the fabric ensures that the garment is form-fitting and that the garment will fit almost all sizes from very small to very large. This "one size fits all" ability enables many different garments and styles to be produced easily and economically and avoids problems for manufacturers and retail stores of producing and stocking a large number of different sizes.

Furthermore, the fabric of the present invention may be used for a variety of other purposes, e.g. as sweatbands for the head, wrists or ankles, or in baby garments (where the considerable stretch of the fabric is of great value as the baby grows and the loop pile gives a towelling appearance which the consumer perceives as desirable). Indeed, the fabric of the invention may be used for any purpose where towelling is currently used but with the additional advantage of considerable elasticity.

I claim:

1. A process for knitting a fabric on a knitting machine having a first set of needles and a second set of needles, wherein a non-contractible yarn is knitted on said first and second sets of needles and a contractible yarn is knitted on said second set of needles only, such that, in each course, said yarns are knitted for at least one stitch and float together over a plurality of missed stitches, a pattern of knitting and floating repeating along said course of the fabric, so that, when said contractible yarn is contracted, said non-contractible yarn forms raised loops upon one face of the fabric.

2. A process according to claim 1, in which said non-contractible yarn is a non-elastic yarn.

3. A process according to claim 1 in which said contractible yarn is an elastic yarn supplied under tension to be knitted.

4. A process according to claim 3, in which the contractible yarn is a spandex yarn.

5. A process according to claim 1 in which said contractible yarn is a shrinkable yarn and, after knitting, is subjected to treatment to cause it to shrink.

6. A process according to claim 1 in which said knitting machine is a cylinder-and-dial machine.

7. A process according to claim 6, in which said knitting machine is a double jersey machine.

8. A process according to claim 1 in which a course of the fabric comprises a plurality of groups of stitches, in which: each group comprises a plurality of stitches in which said contractible and non-contractible yarns are knitted in by said second set of needles, each adjacent pair of stitches within said group being separated by a region where said contractible yarn floats over at least a single needle whilst said non-contractible yarn is knitted in by said first set of needles; and adjacent pairs of said groups being separated by a region where said contractible and non-contractible yarns float over a plurality of needles.

9. A process according to claim 1 in which, in each course, the ratio of the number of needles where no knitting takes place to the number of needles where knitting takes place is at least 2:1.

10. A process according to claim 9, in which said ratio is at least 3:1.

11. A process according to claim 9, in which said ratio is at least 4:1.

12. A process according to claim 1 in which in each course the repeating pattern comprises the following sequence:

(a) knit from 1 to 3 stitches of said contractible and non-contractible yarns on said second set of needles;
(b) miss from 1 to 3 stitches on said second set of needles and knit said non-contractible yarn on said first set of needles;
(c) repeat (a) and (b) at least once;
(d) miss on both sets of needles from 4 to 15 stitches counting stitches missed on said first set of needles; and
(e) repeat (a)–(d) along the course.

13. A process according to claim 12 in which the repeating pattern comprises:

(a) knit one stitch of said contractible and non-contractible yarns on said second set of needles;
(b) miss one stitch on said second set of needles and knit 1 corresponding stitch of said non-contractible yarn on said first set of needles;
(c) repeat sequence (a) and (b) from 1 to 2 times;
(d) miss from 6 to 12 stitches on both sets of needles; and
(e) repeat (a)–(d) along the course of the fabric.

* * * * *